US007302917B2

(12) United States Patent
Remark et al.

(10) Patent No.: US 7,302,917 B2
(45) Date of Patent: Dec. 4, 2007

(54) CHEMICAL CLEANING OF A STEAM GENERATOR DURING MODE 5 GENERATOR SHUT DOWN

(75) Inventors: John F. Remark, Lynchburg, VA (US); Sarah E. Evans, Lynchburg, VA (US)

(73) Assignee: Framatome Anp, Inc., Lynchburg, VA (US)

( * ) Notice: Subject to any disclaimer, the term of this patent is extended or adjusted under 35 U.S.C. 154(b) by 185 days.

(21) Appl. No.: 11/212,250

(22) Filed: Aug. 27, 2005

(65) Prior Publication Data

US 2006/0065212 A1 Mar. 30, 2006

(51) Int. Cl.
*C23G 1/00* (2006.01)
*F22B 37/48* (2006.01)

(52) U.S. Cl. ..... 122/379; 134/2

(58) Field of Classification Search ..... 122/379, 122/396; 134/2, 3

See application file for complete search history.

(56) References Cited

U.S. PATENT DOCUMENTS 3,684,720 A * 8/1972 Richardson ..... 507/241
4,632,705 A * 12/1986 Baum ..... 134/3
5,264,041 A * 11/1993 Kuhnke et al. ..... 134/2
5,368,775 A * 11/1994 Rossi et al. ..... 252/392
5,575,863 A * 11/1996 Sala et al. ..... 134/2
5,841,826 A * 11/1998 Rootham et al. ..... 376/316

OTHER PUBLICATIONS

Effect of Chemical Cleaning on Steam Generator Tube Performance website: http://www.informaworld.com/smpp/content~content=a713855461~db=all.*

* cited by examiner

*Primary Examiner*—Gregory Wilson
(74) *Attorney, Agent, or Firm*—Vytas R. Matas

(57) ABSTRACT

A Nuclear Steam Supply Stem (NSSS) Mode 5 Steam Generator Chemical Cleaning system is disclosed which applies chemical cleaning solvent (formulated to remove SG deposits) to the secondary side of the SG using primary side supplied heat during NSS Mode 5 shutdown to maintain the desired application temperature. Mixing is achieved via nitrogen sparging.

7 Claims, 2 Drawing Sheets

CHEMICAL CLEANING OF A STEAM GENERATOR DURING MODE 5 GENERATOR SHUT DOWN

BACKGROUND OF THE INVENTION

1. Field of the Invention

The present invention is generally drawn to the chemical cleaning of iron and corrosion buildup in a steam generator and more particularly to a low temperature chemical cleaning of such unwanted buildup.

2. Description of the Prior Art

Previous low temperature chemical cleaning applications performed on NSSS steam generators (SG) were based on the research and development of the process cleaning steps conducted by the Electric Power Research Institute (EPRI) and Steam Generator Owners Group (SGOG) in the April 1983 (EPRI Report NP-3009) entitled "Steam Generator Chemical Cleaning Process Development" which is hereby included in this application by reference thereto and with a copy of the report enclosed. The application technique employed for the EPRI/SGOG chemical cleaning required the utility to be shutdown and the SG drained prior to initiation of the cleaning application so that connections could be made to inject the cleaning solutions. Since the solutions required heating and/or cooling based on the sequence of steps to be applied, different methods of achieving process temperature control have been implemented always using an external heat exchanger source requiring a considerable amount of equipment and manpower to perform the cleaning application successfully. A schematic of such a prior art chemical cleaning setup is seen in FIG. 1.

The above cited EPRI report teaches that low temperature chemical cleaning be conducted at 200 degrees ° F. and is stated to be effective for iron removal from a steam generator and for passivation of the cleaning surfaces. It recommends different temperatures, chemical formulations and exposure times for copper removal, cleaning of dents, crevices etc. The report was complied using a mock steam generator and did not test the use of nitrogen sparging. It did disclose various formulations of chemicals for effective low temperature cleaning but only after full shut-down of the steam generator.

Certain patents also teach the use of chemical cleaning. Some of these patents use chemical cleaning in conjunction with pressure pulses in the solution to improve cleaning (U.S. Pat. No. 5,841,826) passivation of cleaning surfaces (U.S. Pat. No. 5,587,025) and a specific formulation for chemical cleaning of metal compounds containing iron (U.S. Pat. No. 5,575,863).

However, the cited references fail to teach the use of chemical cleaning during a Mode 5 (200 degrees F.) steam generator shut-down operation with nitrogen sparging to mix the chemicals and obviate the need for numerous recycles and thus requiring no external heat source.

SUMMARY OF THE INVENTION

The present invention is drawn to a process for chemical cleaning of a steam generator during Mode 5 steam generator shut-down operation using known chemical formulations and nitrogen sparging in the steam generator to mix the chemicals eliminating multiple drain and refill operations used in prior art methods.

The process involves waiting until the plant operation is lowered from a mode 4 higher temperature shut-down operation to mode 5 operation at approximately 200 degrees F. to 210 degrees F. A precalculated amount of chemical cleaning solvent is then injected from a container holding the solution into the steam generator through blowdown lines running along the bottom of the steam generator at the tubesheet. A nitrogen sparge is intermittently introduced into the steam generator to mix the solvent. The solvent is then removed from the steam generator. This process takes approximately 24-36 hours.

In view of the above it will be seen that one aspect of the present invention is to perform the chemical cleaning of the steam generator during the mode 5 shut-down operation to allow simultaneous cleaning and other normal repair work done during the different shut-down stages.

Another aspect is to provide such chemical cleaning during the mode 5 stage of shut-down operation; thus, relieving containment congestion and reducing equipment requirements.

Yet another aspect is to provide such chemical cleaning at a low temperature of approximately 200 degrees F.-210 degrees F.

Still yet another aspect is to provide nitrogen sparging during such a chemical cleaning operation.

These and other aspects of the present invention will be more fully understood upon a review of the following description of the preferred embodiment when considered along with the drawings.

DESCRIPTION OF THE PREFERRED EMBODIMENT

Figure 1:
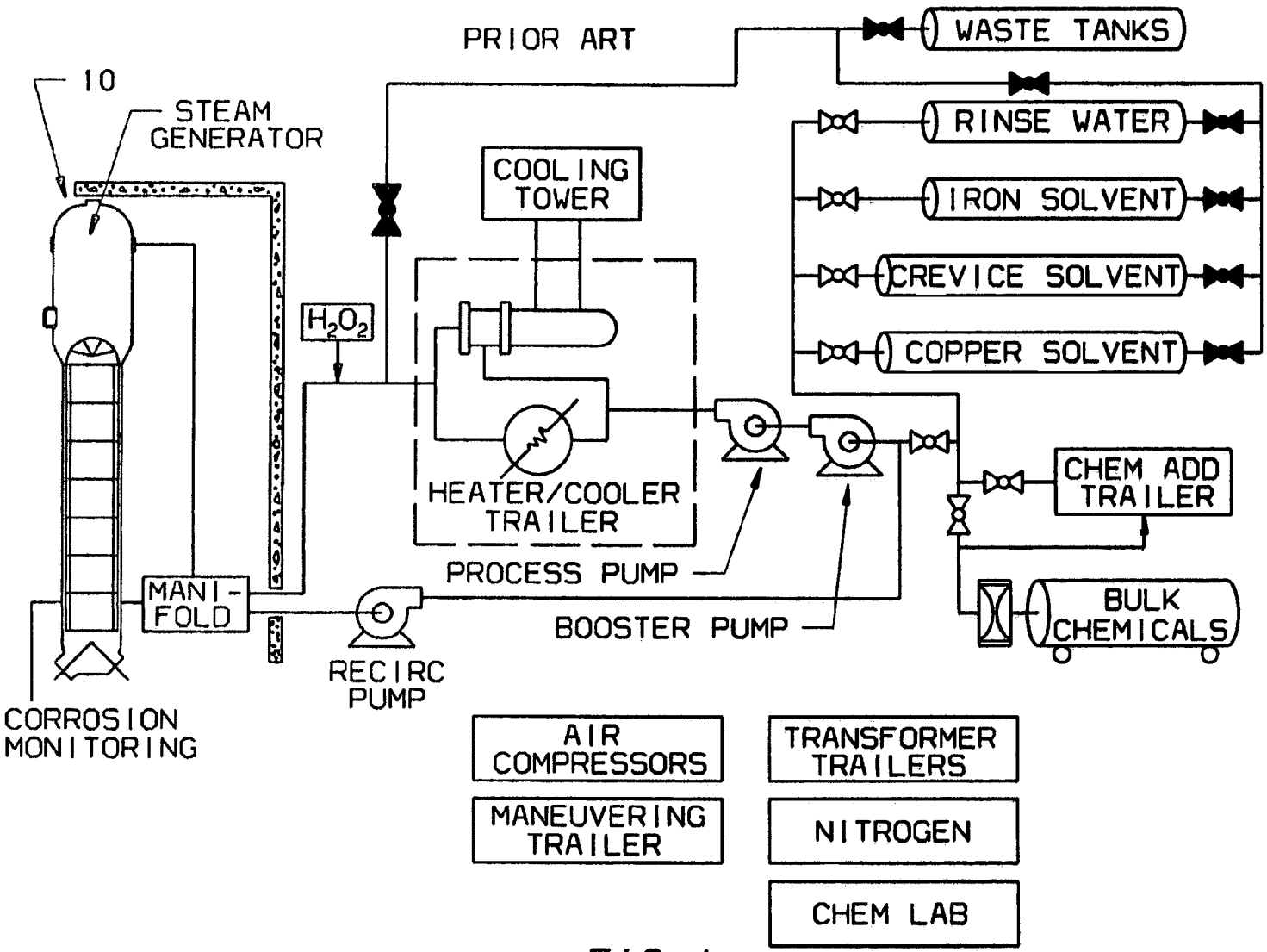
FIG. 1 is a schematic of prior art chemical cleaning operations after shut-down of the steam generator.

A normal steam generator shut-down comprises a series of modes namely 1-5 each having a temperature cooling band running from mode 1 being the highest to mode 5 being the lowest (200 degrees F.-210 degrees F.). The normal operating temperature of a commercial steam generator is approximately 575 degrees F. to 610 degrees F.

The above modes of operation for the plant steam generator are defined by the National Regulatory Commission (NRC). Typically, pressurized water reactors (PWRs) transition from Mode 4 to Mode 5, depends upon the specific site, at temperatures ranging from 210 degree F. down to 200 degrees F. The temperature band defined for each mode of operation increases with decreasing mode level. As the plant progresses into lower temperature modes of operation, is less contingency safety equipment is required by the NRC to be on line and functional in order to remain in that mode of operation to allow the performance of certain designated work activities safely.

Figure 2:
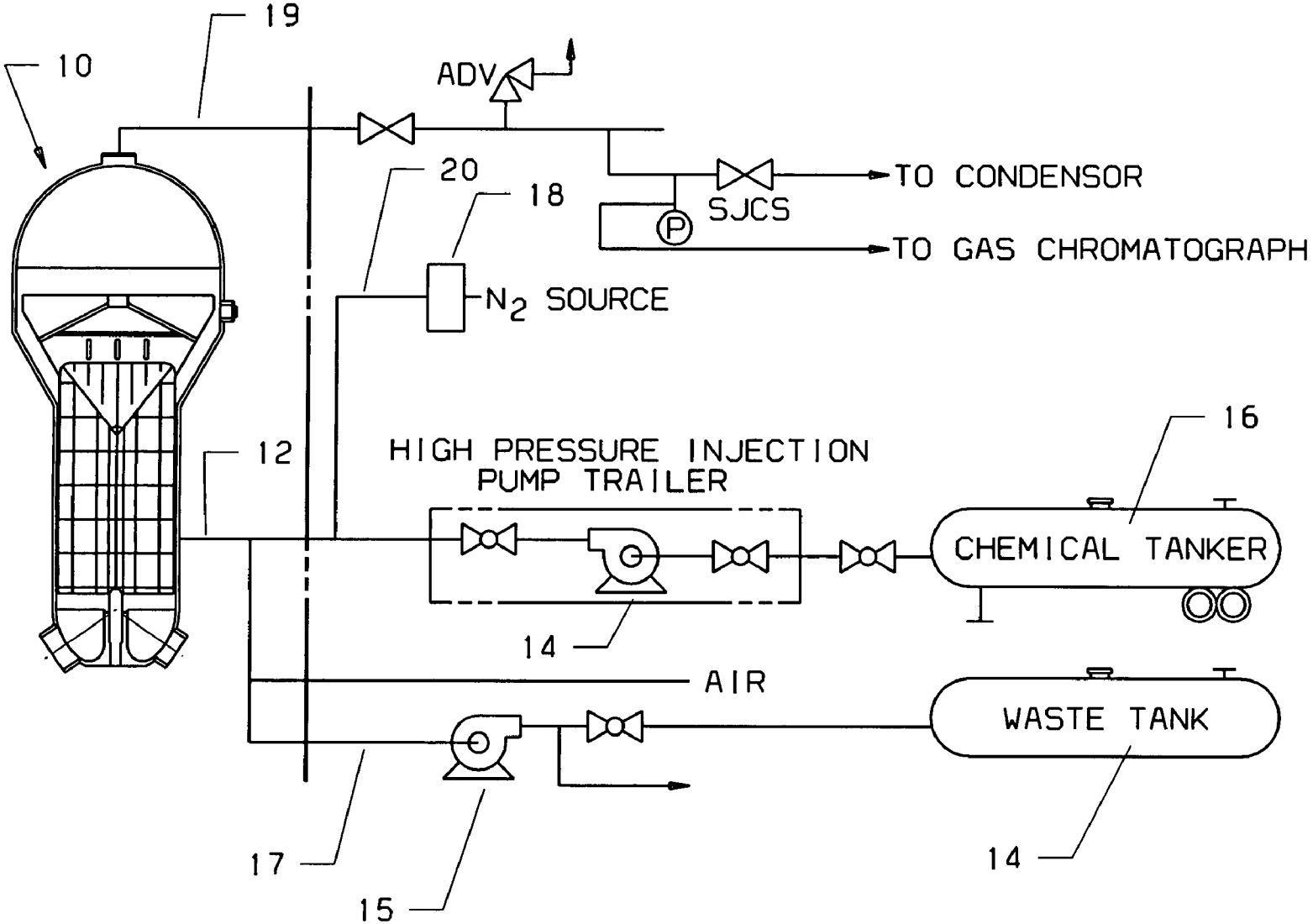
FIG. 2 is a schematic of the Mode 5 chemical cleaning operation of the present invention.

Referring now to the FIG. 2 it will be seen that the steam generator (10) has progressed from the initial Mode 1 operation down to the Mode 5 operating level where chemical cleaning may now be initiated.

Once at the Mode 5 temperature, the cleaning solvent is injected into the SG (10) via a blowdown line (12) which is typically a 2-4" line that runs along the bottom of the SG at the tubesheet. During normal plant operations, this line would be used to remove water from the SGs, but chemicals can now be introduced at this location using appropriately sized injection pumps (14).

Heat input to the steam generators during the chemical cleaning application is achieved via heat transfer from the primary side. Heat sources range from decay heat of the nuclear fuel to the heat generated from operation of the reactor coolant pumps. The SG (10) temperature is lowered (to achieve Mode 5) via steaming to the condenser along with cooling supplied from the decay heat removal system.

The Mode 5 chemical cleaning uses a similar solvent formulation as the solvents developed by EPRI/SGOG, but the application technique is significantly different. A Mode 5 chemical cleaning is applied using primary side heat as the heat source to minimize the amount of equipment required for the cleaning application, and, subsequently, to minimize costs to perform the cleaning. The anticipated effectiveness of the Mode 5 process in removing any desired amount of iron deposit loading would be equivalent to the EPRI/SGOG process which uses EDTA, hydrazine, ammonium hydroxide and a corrosion inhibitor. SG (10) connections are minimal, requiring only a hookup to each of the SG blowdown lines (12) so that the chemicals may be pumped in to and drained out of the SG (10) to the tank (14) by a pump (15) along line (17) connected to line (12) after the appropriate time in the reactor. Nitrogen sparging is utilized during the application of the solvent for mixing as well as the mixing gained via thermal convection. The nitrogen sparging can also be utilized to pressurize the SG. The pressurization of the SG is a backup for draining the solvent. In addition, a sampling technique is implemented which allows for taking a portion of the SG solvent volume along line (17) to check the samples for the cleaning effect on the steam generator. The solvent volume may be returned to the SG if the cleaning is not finished. The normal application time of solvent to the SG is estimated to be about 24-36 hours.

Since this cleaning process is applied in Mode 5, the SGs may be cleaned in parallel such that the total time for the iron removal step should be no more than 24-36 hours or 2-3 shifts minimizing the duration of the process application. If prior art is utilized typically no more than two steam generators could be cleaned simultaneously due to heat requirements. The process formulation is maintained in chemical tanker/s (16) and may be adjusted for the estimated deposit loading and qualified for optimum deposit removal and sufficient driving force for the dissolution kinetics to ensure reasonable application duration. The nominal driving force at 200 degrees F. is an excess of 40 g/l EDTA based on the stoichiometric requirements of the estimated deposit loading. Corrosion of carbon steel during this process should be low based on the EPRI/SGOG data. Qualification testing of the process indicates that corrosion is best controlled by modifying process duration. For a deposit loading ranging up to 1,500 lbs of deposit with an SG volume of 31,000 gallons, the maximum chelant concentration required for the solution would be approximately 60-65 g/L EDTA which includes sufficient driving force to promote dissolution of the deposit. Predicted carbon steel corrosion, based on industry data, suggests that this process can be applied with a maximum corrosion of 1-2 mils. This would allow multiple applications of the process without significant impact on the SG critical components and materials. The equipment requirements are moderate and require a nominal lay-down and setup area for process implementation and potentially waste processing. Area and equipment setup and operation would require no more manpower or site support than is required during previous known Mode 4 HTCC chemical cleaning applications.

The impact on outage schedule would be approximately 2-3 shifts or 24-36 hours which is the same as the Mode 4 application with a very good projected effectiveness in deposit removal.

The solvent formulation and corrosivity is a well documented technology when using external heating and recirculation. Experience with chemical cleaning and other research and development projects indicate the process would be as successful as previously observed using plant heat. Additional optimization of the solvent formulation to determine the necessary driving force of chelating agent at the lower temperature to ensure optimum deposit removal and a quantification of the corrosivity of the solution can be easily done.

As was stated, the basic solvent formulation of the Mode 5 chemical cleaning application uses the same constituents as the chemical cleaning solvents developed by EPRI/SGOG as described in EPRI Report NP-3009. However, each solvent formulation is tailored to the site specific deposit loadings and materials of construction. Utilities are looking for preventative means to maintain their stem generators rather than holding out until the corrosion mechanisms caused by higher deposit loading requires extensive cleaning that can not be accomplished by mechanical methods. Based on these lower deposit loadings, the required solvent chelating capacity, provided by the chelating agent ethylenediaminetetraacetic acid (EDTA), is also lowered. The original EPRI/SGOG qualification testing evaluated an EDTA concentration in the range of approximately 100-200 g/L EDTA. In today's industry, the solvent formulation may be formulated at concentrations as low as 40 g/L or as high as 250 g/L EDTA (equivalent to deposit loading ranging from 2,740 lbs to 17,120 lbs of magnetite (Fe3O4); thus, expanding the original qualified range of chelating concentration.

In addition, during the EPRI/SGOG development testing, several corrosion inhibitors were evaluated and the proprietary Petrolite inhibitor, CCI-801, was determined to provide the best inhibition at a concentration of 1%. With the change in deposit loading, application temperature, and the age of the steam generators, higher concentrations of inhibitor have been required to mitigate and/or eliminate general corrosion wastage and initiation of pitting.

Another aspect of the Mode 5 application is the use of nitrogen, N2, for mixing of the solvent in the steam generators. Use of the nitrogen sparge into the steam generator eliminates the necessity for multiple drain and refill operations and recirculation. While chemical cleaning solvent is introduced to the SGs at the above formulation concentrations, pre-mixed in the process tank (16) to the concentration; and injected in a concentrated form and diluted in the SGs with the plant auxiliary or main feedwater system or just prior to entry into the SG by the use of plant demineralized water. Plant auxiliary or main feedwater is also required during the Mode 5 cleaning application to provide a rinse of the SG internals during and/or at the completion of the cleaning to dilute the solvent heel(s) to acceptable levels for the plant to enter into wet layup conditions or further outage tasks scheduled to be performed on the SGs'.

The nitrogen sparging is done by introducing nitrogen to line (12) from a pressurized nitrogen source (18) which adds nitrogen at a volume of 250-1500 cubic ft/minute for a 10 minute interval every half hour along line (20) which is connected to the line (12) pumping the chemical cleaning solution from tanker (16) to the SG (10). The nitrogen flow rate is dependant upon the volume of the SG as well as the available size of the blowdown line connections. Furthermore, the nitrogen flow rate impacts the duration of the application such that the smaller the flow rate the longer the time required achieving optimum mixing.

From the foregoing it will be seen that this Mode 5 chemical cleaning system reduces the amount of equipment and personnel required for chemical cleaning compared to a traditional EPRI/SGOG application using external heat. Applying the process in Mode 5 also allows the containment building to be opened thus permitting other outage work to be performed in conjunction with the cleaning and removing it from critical path unlike the Mode 4 application which is typically on critical path for the duration of the application. These advantages ultimately reduce process application and outage costs. In addition the process has the potential for removing various degrees of deposit loadings.

Certain details and modifications have been deleted herein for the sake of conciseness and readability but are fully intended to fall within the scope of the following claims.

We claim:

1. A method of cleaning a steam generator during mode 5 shut down operations at approximately 200 degrees F. to 210 degrees F. comprising the steps of:

using the steam generator primary side heat as the heat source to maintain the desired temperature;

injecting a precalculated amount of chemical cleaning solvent into the steam generaror;

introducing a nitrogen sparge into the steam generator to mix the solvent;

intermittently sampling the solvent to determine the cleaning effect of the solvent; and removing the mixed solvent after a predetermined period of time.

2. A method of cleaning a steam generator as set forth in claim 1 wherein the chemical cleaning solvent is introduced into the steam generator along blowdown lines located along the bottom of the steam generator at the tubesheet.

3. A method of cleaning a steam generator as set forth in claim 1 wherein the nitrogen sparge is introduced intermittently.

4. A method of cleaning a steam generator as set forth in claim 3 wherein the sparge is introduced intermittently at a rate of 250-1500 cubic ft/minute.

5. A method of cleaning a steam generator as set forth in claim 4 wherein the nitrogen is introduced for 10 minute intervals every half hour.

6. A method of cleaning a steam generator as set forth in claim 1 wherein the mixed solvent is removed after approximately 24-36 hours.

7. A method of cleaning a steam generator as set forth in claim 1 including the step of returning the sample to the steam generator if the cleaning effect is not completed.

* * * * *